United States Patent [19]

Gammon et al.

[11] 4,212,667

[45] Jul. 15, 1980

[54] BLAST FURNACE SMELTING OF ZINC

[75] Inventors: Michael W. Gammon; Colin F. Harris, both of Bristol, England

[73] Assignee: Metallurgical Development Company, Nassau, The Bahamas

[21] Appl. No.: 966,732

[22] Filed: Dec. 5, 1978

[30] Foreign Application Priority Data

Dec. 12, 1977 [GB] United Kingdom ..... 51543/77

[51] Int. Cl.[2] ..... C22B 19/08

[52] U.S. Cl. ..... 75/86

[58] Field of Search ..... 75/86, 87, 88; 266/184, 266/154

[56] References Cited

U.S. PATENT DOCUMENTS 1,080,102 12/1913 Cutten ..... 75/87

FOREIGN PATENT DOCUMENTS 854010 11/1960 United Kingdom ..... 266/184

*Primary Examiner*—M. J. Andrews

*Attorney, Agent, or Firm*—Holman & Stern

[57] ABSTRACT

A method of smelting zinc in a blast furnace wherein the furnace is charged sequentially with separate loads of coke and agglomerated zinc oxide material, wherein, for a major proportion of the total operating time which is devoted to coke charging, from 25% to 50% by weight of the coke charged is directed towards the center of the furnace shaft so as to promote a coke-rich charge core, the remainder of the coke charged being directed towards the furnace walls, and wherein for a minor proportion of the said total operating time from 80% to 95% by weight of the coke charged is directed towards the walls of the furnace shaft to aid accretion melting, the remainder of the coke charged being directed towards the center of the furnace shaft.

12 Claims, 1 Drawing Figure

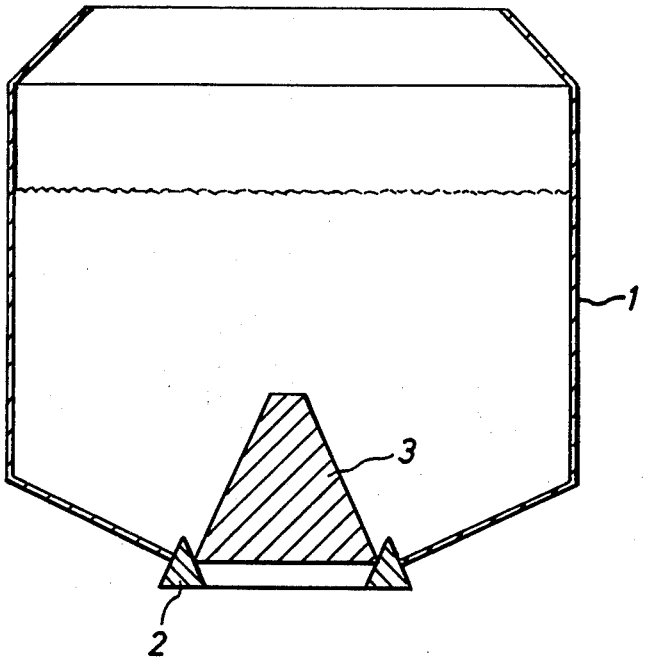
1
3
2

BLAST FURNACE SMELTING OF ZINC

This invention relates to the blast furnace smelting of zinc, and more particularly to the charging of a zinc-smelting blast furnace.

The smelting of zinc in a blast furnace is now a well-known industrial technique, having been practised on an industrial scale since the early 1950's (see for example "Application of the Blast Furnace to Zinc Smelting" by Morgan and Woods, published in Metallurgical Reviews, November 1971, pages 161–174). In this process the furnace is charged at the top thereof with agglomerated zinc oxide material, usually as a sinter, and a carbonaceous reducing agent such as coke, and air or oxygen-enriched air is introduced through tuyeres at the furnace bottom and a zinc-vapour-bearing gas is taken off through an offtake near the top of the shaft, zinc being considered from this gas by means of a condenser which is irrigated with a spray of molten lead droplets. A molten slag (and any lead in the oxidic charge) is tapped from the furnace bottom.

With the increasing cost of metallurgical coke it is more than ever important to make pyro-metallurgical processes as efficient as possible with respect to fuel economy, i.e. to minimize the ratio of coke burned to zinc metal recovered. The zinc-smelting blast furnace has the characteristic of operating with a relatively hot top, i.e. the top of the shaft is at 900°–1000° C. compared with 300°–400° C. for an iron blast furnace.

Furthermore, the zinc blast furnace has a tendency to form accretions (fritted charge bonded together with zinc and lead compounds) which build up on the walls of the furnace. In order to remove these accretions it is necessary either to resort to mechanical cleaning methods (e.g. drilling or blasting) at shut-down periods or to attempt to remove the accretions by reducing and melting them while the furnace is on-line.

The normal mode of charging a zinc-smelting blast furnace is by means of a bell-and-hopper arrangement which is used to charge sequentially one load of coke followed by one load of sinter and then repeating this sequence.

The present invention provides a method of smelting zinc in a blast furnace wherein the furnace is charged sequentially with separate loads of coke and agglomerated zinc oxide material, wherein, for a major proportion of the total operating time which is devoted to coke charging, from 25% to 50% by weight of the coke charged is directed towards the center of the furnace shaft so as to promote a coke-rich charge core, the remainder of the coke charged being directed towards the furnace walls, and wherein for a minor proportion of the said total operating time from 80% to 95% by weight of the coke charged is directed towards the walls of the furnace shaft to aid accretion melting, the remainder of the coke charged being directed towards the center of the furnace shaft.

Preferably the agglomerated material is in the form of a sinter produced by roasting one or more sulphidic zinc or zinc/lead ores on a sinter strand. Alternatively the agglomerated material may be a hot-briquetted zinc or zinc/lead oxidic material produced by briquetting fine zinc oxide or zinc oxide and lead oxide with the aid of heat and pressure.

Preferably the charge is introduced into the furnace shaft by means of a double-bell-and-hopper charging system, wherein the lower opening of the charge hopper is closable by means of a central bell/annular bell combination of which the annular bell is capable of being lowered by a pre-determined fixed distance while the central bell may be raised or lowered by a variable distance smaller than the fixed distance.

Thus in order to promote coke-rich center charging of the furnace shaft, for the purpose of fuel economy, coke is placed in the hopper of the double-bell-and-hopper system, and the annular bell is lowered by the pre-determined distance while the central bell is normally kept static or raised or lowered by a smaller distance, so as to discharge for example 40% of the coke through the aperture in the annular bell and the rest to the walls of the furnace shaft. With sinter placed in the hopper, the annular bell is lowered as before by the pre-determined distance, and the central bell is moved so that its final position is lower than its final position during the previous coke charge.

In order to promote coke-rich wall charging of the furnace shaft, for the purpose of accretion removal therefrom, coke is placed in the hopper, and the annular bell is lowered by the pre-determined distance while the central bell is lowered by a smaller distance, so as to discharge for example 90% of the coke to the furnace walls and the rest through the aperture in the annular bell. With sinter placed in the hopper, the annular bell is lowered by the pre-determined distance, and the central bell is moved so that its final position is higher than its final position during the previous coke charge.

In order to maintain a substantially level stock line at the top of the furnace, the sinter charges interposed between the coke charges are preferably arranged to compensate for differences in level due to the coke distributions set out above.

As a further control on the distribution of the hopper contents between the center and the walls of the furnace shaft, the speed of lowering the annular bell may be varied, i.e. the slower is the speed of the lowering of the annular bell the more charge is distributed to the centre of the shaft, for a given upward central bell movement.

In general the annular bell/central bell charge apparatus is as described in for example British Pat. No. 810,928 or 854,010, although in the present application it is important that the central bell can be raised or lowered by variable distances and in no case should the central bell pass through the central aperture of the annular bell.

It is also preferable that the lowering of the annular bell is commenced before any vertical upwards or downwards movement of the central bell is commenced. In this way stresses on the central bell gear, due to the weight of charge in the hopper, are minimized.

The invention will be further described, by way of example only, with reference to the accompanying drawing, which is a diagrammatic sectional view through the bottom of a double-bell-and-hopper charging apparatus for use in carrying out the method of the present invention.

The drawing shows a charge hopper having side walls 1, an annular discharge bell 2, and a central discharge bell 3.

With a charge held within the walls 1 of the hopper and the bells 2 and 3 in their closed position (as shown), the upper hopper opening (not shown) is closed by means of a sealing bell and the furnace is ready for charging. For coke-rich center charging of the furnace shaft, above which the charging apparatus is positioned, for the purpose of fuel economy, coke is placed in the hopper, the annular bell 2 is lowered by a pre-determined distance (say 2 feet), and the central bell 3 is either kept static or raised or lowered by up to 12 inches, so that 25%–50% by weight of the coke contained in the hopper passes through the aperture in the annular bell.

For coke-rich charging of the walls of the furnace shaft for wall cleaning operations, coke is placed in the hopper, the annular bell 2 is lowered by the pre-determined distance and the central bell 3 is lowered by a smaller distance (e.g. 6 inches to 1 foot), so that 5% to 20% by weight of the coke contained in the hopper passes through the apertures in the annular bell.

Thus in the first-mentioned situation more of the hopper contents flow to the centre of the furnace shaft than to the walls thereof, whereas in the second-mentioned situation more of the hopper contents flow to the walls of the shaft than to the center thereof. Thus if the hopper contents are predominantly coke the first mode of operation leads to coke-rich center charging of the furnace shaft and the second mode to coke-rich wall charging thereof. If the hopper contents are predominantly sinter then the first mode of operation leads to sinter-rich center charging of the furnace shaft and the second mode to sinter-rich wall charging thereof.

If it is desired to increase the percentage of hopper contents charged to the center of the furnace then the speed of lowering the annular bell may be reduced, slower speeds giving a higher percentage distribution of hopper contents to the center of the furnace when the central bell is raised. In this way the percentage of the hopper contents directed towards the center of the furnace may be increased to 50%.

In some exceptional circumstances it may be desirable for short operating periods to discharge more than 50% of the hopper contents towards the center of the furnace shaft; this may be achieved as outlined above by reducing the speed of lowering of the annular bell. This is of course subject to the overall requirement that not more than 50% by weight of the coke charged is directed towards the center of the furnace shaft during a major proportion of the total operating time which is devoted to coke charging.

We claim:

1. A method of smelting zinc in a blast furnace wherein the furnace is charged sequentially with separate loads of coke and agglomerated zinc oxide material, comprising, for a major proportion of the total operating time which is devoted to coke charging, centrally directing from 25% to 50% by weight of the coke charged towards the center of the furnace shaft so as to promote a coke-rich charge core, while annularly directing the remainder of the coke charged towards the furnace walls, and for a minor proportion of said total operating time annularly directing from 80% to 95% by weight of the coke charged towards the walls of the furnace shaft to aid accretion melting, while centrally directing the remainder of the coke charged towards the center of the furnace shaft.

2. The method according to claim 1, wherein the agglomerated zinc oxide material is a sinter produced by roasting at least one sulphidic zinc ore on a sinter strand.

3. The method according to claim 1, wherein the agglomerated zinc oxide material is a sinter produced by roasting at least one sulphidic zinc/lead ore on a sinter strand.

4. The method according to claim 1, wherein the agglomerated material is a hot-briquetted zinc oxidic material.

5. The method according to claim 1, wherein the agglomerated material is a hot briquetted zinc/lead oxidic material.

6. The method according to claim 1, comprising effecting charging by utilizing a double-bell-and-hopper charging system, wherein the lower opening of the charge hopper is closed by means of a central bell/annular bell combination of which the annular bell is capable of being lowered by a pre-determined fixed distance while the central bell can be moved vertically in either direction by a variable distance smaller than said fixed distance.

7. The method according to claim 6, comprising, for coke-rich center charging, placing coke in the hopper, and lowering the annular bell by said pre-determined fixed distance while keeping the central bell static.

8. The method according to claim 6, comprising, for coke-rich centre charging, placing coke in the hopper and lowering the annular bell by said pre-determined fixed distance while moving the central bell vertically in either direction by a distance smaller than said fixed distance.

9. The method according to claim 6, comprising, for coke-rich wall charging, placing coke in the hopper, and lowering the annular bell by said pre-determined fixed distance while lowering the central bell by a distance smaller than said fixed distance.

10. The method according to claim 6, comprising varying the speed of lowering the annular bell so as to vary the proportion of a coke charge fed to the centre of the shaft.

11. The method according to claim 6, comprising commencing the lowering of the annular bell before commencing any vertical movement of the central ball, so as to minimize stresses on the central bell.

12. The method according to claim 1, comprising arranging sinter charges interposed between the coke charges so as to keep a substantially level stock line at the top of the furnace.

* * * * *